United States Patent [19]

Walker

[11] 3,997,038

[45] Dec. 14, 1976

[54] WHEELED SUITCASE

[76] Inventor: Brooks Walker, 807 Francisco St., San Francisco, Calif. 94109

[22] Filed: June 23, 1975

[21] Appl. No.: 589,073

[52] U.S. Cl. ..... 190/18 A

[51] Int. Cl.[2] ..... A45C 5/14

[58] Field of Search ..... 190/18 A; 46/221; 280/35, 47.24, 47.26

[56] References Cited

UNITED STATES PATENTS

| | | | |
|---|---|---|---|
| 1,642,502 | 9/1927 | Krasberg | 280/35 |
| 2,409,786 | 10/1946 | Norton | 280/47.26 |
| 2,775,847 | 1/1957 | Herdklotz | 46/221 |
| 2,919,138 | 12/1959 | Brower | 190/18 A X |
| 3,163,268 | 12/1964 | Leavell | 190/18 A |
| 3,799,568 | 3/1974 | Hager | 190/18 A X |
| 3,805,929 | 4/1974 | Kuwayama | 190/18 A |

*Primary Examiner*—Donald F. Norton
*Attorney, Agent, or Firm*—Gordon Wood

[57] ABSTRACT

The ground wheels of a wheeled suitcase are provided with axles, and mounting means are formed on the suitcase to permit the axles to be readily secured and removed.

4 Claims, 10 Drawing Figures

WHEELED SUITCASE

This invention relates to suitcases of a type provided with ground wheels to facilitate transporting the same. The main object of the present invention is the provision of a wheel structure including an axle and means on the suitcase to permit the axle to be readily applied and removed therefrom. In this way damage to the wheel structure is obviated during rough handling in loading and unloading.

Another object of the invention is the provision of means for applying wheels to a suitcase or bag of the type which is formed of relatively flexible material such as the type of bag known by the trademark Valpack.

Yet another object of the invention is the provision of a wheel structure including an axle which is adapted to be stored in a minimum amount of space when the wheels are not being used as when the case is being transported in the normal manner as on a plane, bus, auto and so forth.

Other objects and advantages will be apparent from the following specification and from the drawings.

Figure 1:
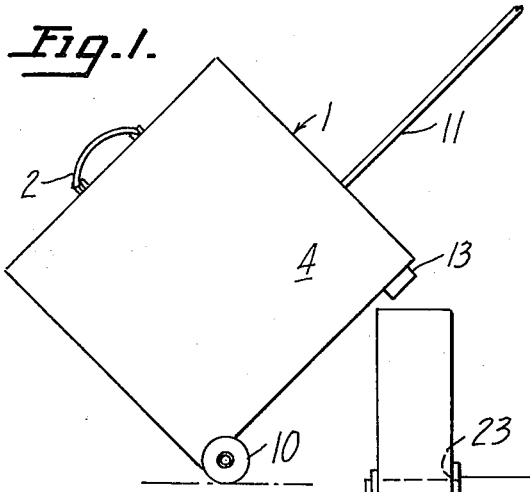
FIG. 1 is a side elevation of a conventional traveling bag of the type formed from flexible material and showing such bag being transported on a pair of attached ground wheels.
Figure 2:
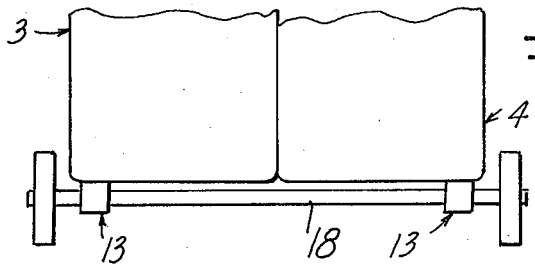
FIG. 2 is a fragmentary end elevation of the bag of FIG. 1. showing the means for mounting the ground wheels.

In detail and referring to FIG. 1, a conventional traveling case is shown of the type which comprises an elongated flexible bag generally designated 1 which is provided with a handle 2 intermediate its ends and which case may be folded at its center to provide two adjacent layers indicated at 3, 4 in FIG. 2.

The traveling bag of FIG. 1 may be pulled on a pair of ground wheels 10 by means of a strap or other flexible element 11 or by means of a substantially rigid telescoping handle. Secured to the lower side of the bag 1 are a plurality of mounts generally designated 13. As seen in FIG. 2, two mounts 13 support the axle and wheels at the rear end of the bag but it will be understood that a pair of similar mounts 13 may be provided at the forward end of the bag if it is desired to transport the bag on four wheels rather than the two wheels shown in FIG. 1. If four wheels are used, the suitcase is readily pulled by means of a strap or other flexible element.

Figure 4:
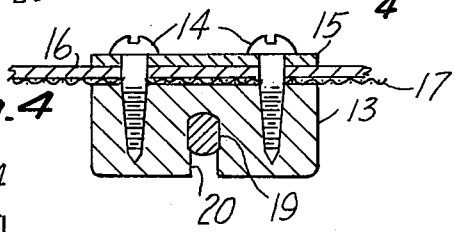
FIG. 4 is a cross sectional view taken in a plane indicated by lines 4—4 of FIG. 3.

As seen in FIG. 4 each mount 13 is preferably secured to the bag by means of self tapping screws 14 which are passed through a washer plate 15 on the inside of the bag and also through the layer 16 of stiffening material and the exterior layer 17 of cloth or other woven material. It will be noted that the pads 13 not only provide a rugged mounting means for the wheel structures to be described, but also act as pads on which the bag may rest when the wheels are not in place. Said pads provide no projections such as screw heads to catch on other objects.

Figure 3:
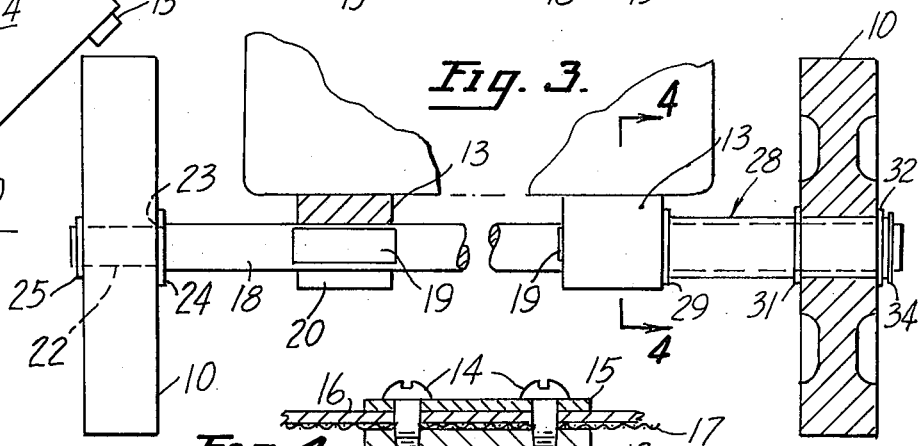
FIG. 3 is a greatly enlarged fragmentary view showing the structure of FIG. 2 in greater detail.

As best seen in FIG. 3, the wheels 10 are rotatably supported at the outer ends of an axle 18. Intermediate the ends of axle 18 the same is preferably provided with flats 19 which reduce the lateral extent of the axle so that the latter may be press fitted within downwardly opening slots 20 in the mounts 13 (see FIG. 4). By this structure it will be noted that longitudinal shifting of the axle 18 is prevented because of the coaction between flats 19 and the mounts 13. Slots 20 are slightly narrower than the cross section of the axle at the flats 19 for a press fit.

In the structure shown in FIG. 3 the left hand end of the axle 18 is preferably reduced in diameter at one end as indicated at 22 to form a shoulder 23 against which a washer 24 may be abutted to prevent inward movement of wheel 10. At the extreme end of axle 18 a snap washer 25 may be provided to retain the wheel 10 in place.

The opposite end of the axle is provided with a sleeve 28 which is formed at one end with a flange 29 to abut the adjacent side of the mount 13. In this case the wheel 10 is rotatably mounted on the sleeve 28 which is provided with snap washers 31, 32 for preventing axial movement of wheel 10 relative to sleeve 28. A snap washer 34 may be mounted on the right hand end of axle 18 to prevent removal of the adjacent wheel structure. Grommet type adaptors may also be press fitted on sleeve 28 in lieu of flanges 29, 31.

Figure 5:
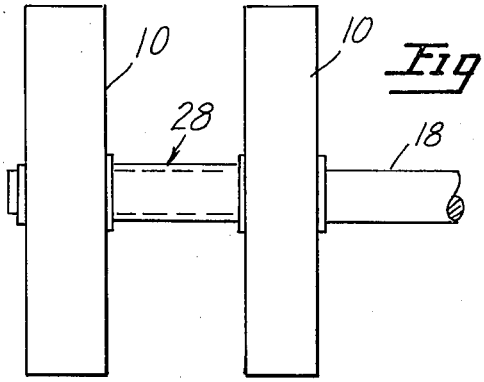
FIG. 5 is a fragmentary side elevation of the ground wheels of FIG. 3 in their stored position.

The advantage of the structure of FIG. 3 is that when the wheel structure, including axle 18, is removed by pulling the axle downwardly out of slots 20 in mounts 13, the right hand wheel 10 with its sleeve 28 may then be slid along the length of axle 18 to a position adjacent the opposite wheel as shown in FIG. 5. This of course facilitates transportation of the wheel structure when it is not in use.

Figure 6:
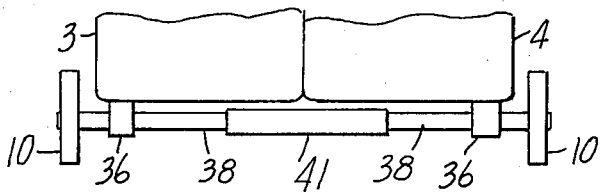
FIG. 6 is a view similar to FIG. 2 showing another form of the invention.
Figure 7:
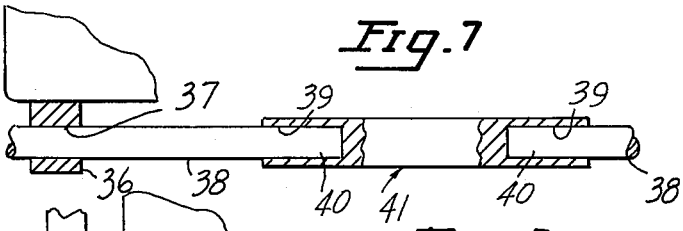
FIG. 7 is an enlarged fragmentary view of the axle of FIG. 6.

Another form of the invention is shown in FIGS. 6, 7 wherein mounts 36 are employed which are in all respects similar to mounts 13 except instead of being provided with downwardly opening slots, said mounts 36 are formed with holes 37 (FIG. 7) for receiving therethrough axles 38 of wheels 10. A central axle portion 41 is provided and formed with axially outwardly opening bores 39 which are adapted to snugly receive therein the end portions 40 of axles 38. The axles 38 fit snugly within the holes 37 in mounts 36 so that said axles may be pushed inwardly through holes 37 to connect with the central portion 41. By this structure three relatively short pieces, that is, axles 38 and their wheels and the central portion 41, may be more conveniently stored when not in use. If desired, the central axle portion 41 and axles 38 may be threadedly secured together.

Another advantage of the structure of FIG. 7 is that there is no likelihood of the axle structure being accidentally separated from the suitcase due to rough handling since the axle portions are received through holes and not retained within slots.

Figure 8:
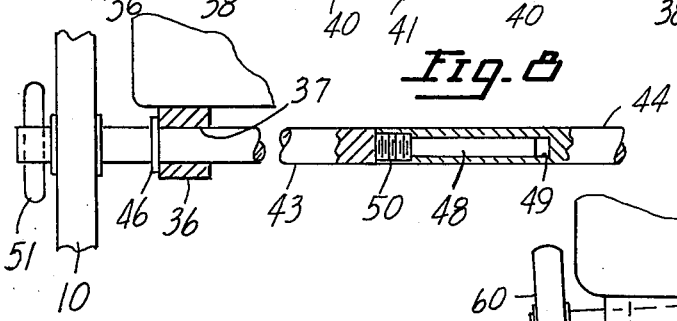
FIG. 8 is a view similar to FIG. 7 showing another form of the invention.

Another form of the invention somewhat similar to that of FIG. 7 is shown in FIG. 8 wherein two axle portions 43, 44 are provided and which axle portions may be slidably received through holes 37 in mounts 36. Each axle portion 43, 44 may be provided with a flange 46 adapted to abut the adjacent mount 36 to prevent accidental axial movement of the axle structure relative to the suitcase when the wheels are in the suitcase supporting position.

The inner end of axle 43 is provided with an elongated coaxial extension 48 adapted to be received within an axially opening bore 49 in axle 44. At the inner end of extension 48, axle 43 is formed with an increased diameter portion 50 which is externally threaded to threadedly receive the complementarily threaded portion of axle 44. By this structure both axles 43, 44 may be passed through the holes 37 in mounts 36 and threadedly secured together to provide a strong structure. In order to facilitate turning the axles 43, 44 relative to each other to permit securement and removal, each of the outer ends of axles 43, 44 may be provided with a transversely extending pin 51 fixedly secured to the axle as seen in FIG. 8.

Although the above structure has been described with reference to securement of the wheels on a flexible suitcase or bag, it will be apparent that the same structures are equally applicable to use with rigid suitcases.

Figure 9:
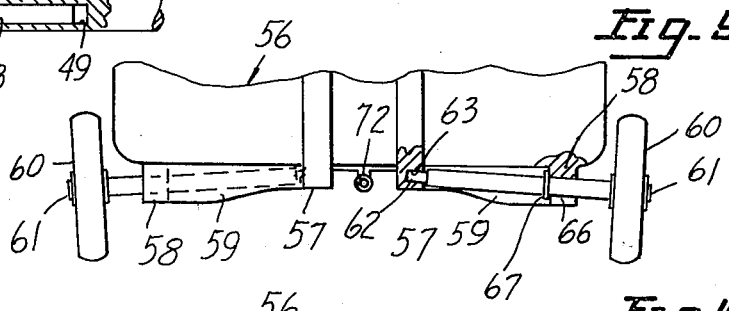
FIG. 9 is a view similar to FIG. 3 showing another form of the invention used on a suitcase of rigid material.

In FIG. 9 a rigid suitcase generally designated 56 is illustrated. This suitcase is of the type that is made of rigid plastic and exemplified by suitcases sold under the name Samsonite. The suitcase 56 includes rigid reinforcing peripherally extending flanges 57 between which is secured hinge 72 and four short flanges 58 which are rigidly secured to flanges 57 and the bottom of the suitcase by means of pairs of webs 59. In this case wheels 60 are rotatably mounted on axles 61 which are formed at their inner ends to provide a reduced diameter portion 62 which is adapted to be received within a drilled opening 63. The flange 58 is provided with a downwardly opening slot 66 in which the axle 61 may be press fitted to secure the wheel structure in place. In order to prevent axial outward movement of the axles 61 they may be provided with flanges 67 which may be secured with a press fit. It will be noted that by the structure of FIG. 9 each of the wheel structures may be readily snapped in place and, when removed, take up only a minimum amount of space in storage.

Figure 10:
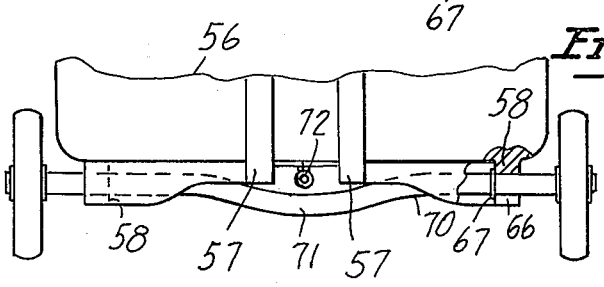
FIG. 10 is a view similar to FIG. 9 showing another form of the invention.

A similar structure is shown in FIG. 10 but in this case a unitary axle 70 is provided which is adapted to be snapped into the two downwardly opening slots 66. In order to avoid interference of the axle 70 with the flanges 57 or hinge 72 of the suitcase, the axle 70 may be provided with a central bent portion 71. The axles of FIGS. 9, 10 may also be provided with flats such as those shown at 19 in FIG. 3. In order to secure the wheels on the axle, washers may be riveted on the ends of the axle and grommet type flanges pressed on the axle similar to flanges 67.

It will be apparent that the above described structures lend themselves to use with any type of suitcase or traveling bag and have the advantage of being readily removed and connected.

Another advantage is that relatively large wheels may be used since they are removed during the time they are subject to damage. Furthermore, no special pockets need be built into the suitcase for storing the wheels in a recessed position.

In the following claims the term "suitcase" will be understood to include flexible bags and other carrying cases as well as conventional rigid suitcases.

I claim:

1. In a wheeled suitcase, a mount fixedly secured to one side of said suitcase, said mount being formed with a downwardly opening slot, an axle, and a wheel rotatably mounted at one end thereof, a portion only of said axle intermediate the ends thereof being press fitted in said slot for securing said wheel to said suitcase.

2. A suitcase according to claim 1 wherein said axle is formed with a flat at said portion to prevent movement of said axle axially of its length relative to said mount.

3. A suitcase according to claim 1 including two wheels rotatably mounted on said axle and wherein one of said wheels is fixed against axial movement, the other of said wheels being slidable along the length of said axle to a stored position closely adjacent said one wheel.

4. A suitcase according to claim 3 wherein a sleeve is provided on said axle on which said other wheel is rotatably supported, said sleeve being slidable with said other wheel along the length of said axle to said stored position.

* * * * *